US007681319B2

(12) United States Patent
Gehlhausen

(10) Patent No.: US 7,681,319 B2
(45) Date of Patent: Mar. 23, 2010

(54) CUTTING WHEEL ASSEMBLY

(76) Inventor: Tina M Gehlhausen, 976 W. Rudolph La., Santa Claus, IN (US) 47579

( * ) Notice: Subject to any disclaimer, the term of this patent is extended or adjusted under 35 U.S.C. 154(b) by 171 days.

(21) Appl. No.: 11/952,541

(22) Filed: Dec. 7, 2007

(65) Prior Publication Data

US 2009/0144990 A1 Jun. 11, 2009

(51) Int. Cl.
*B26D 1/143* (2006.01)

(52) U.S. Cl. ..... 30/319; 30/151

(58) Field of Classification Search ..... 30/151, 30/162, 307, 319; D7/694
See application file for complete search history.

(56) References Cited

U.S. PATENT DOCUMENTS 209,065 A * 10/1878 Millspaugh ..... 30/319
4,942,663 A * 7/1990 Ray, Sr. ..... 30/151
D355,815 S * 2/1995 La Gro ..... D7/694
5,425,160 A * 6/1995 Krapf ..... 24/67 R
5,428,898 A * 7/1995 Hawkins ..... 30/295
5,504,998 A * 4/1996 Nguyen ..... 30/319
D375,622 S * 11/1996 Croft ..... D3/217
D397,001 S * 8/1998 Antista et al. ..... D7/694
6,675,689 B2 * 1/2004 Nunez et al. ..... 83/745
7,093,363 B1 * 8/2006 Kuo ..... 30/47
7,134,209 B1 * 11/2006 Molenaar ..... 30/319
7,363,710 B2 * 4/2008 Kortleven et al. ..... 30/143
2004/0231475 A1 * 11/2004 Cornfield et al. ..... 83/13
2005/0028388 A1 * 2/2005 Liu ..... 30/319
2008/0016699 A1 * 1/2008 Chang ..... 30/151

* cited by examiner

*Primary Examiner*—Hwei-Siu C Payer
(74) *Attorney, Agent, or Firm*—Eric R. Wandel

(57) ABSTRACT

The present invention is a portable compact cutting wheel assembly designed to be easy and convenient to use for cutting food items. The cutting wheel assembly includes a handle, a rotatably attached cutting blade and a conformal blade cover that fits over the cutting blade and secures to the handle for clean storage.

5 Claims, 4 Drawing Sheets

CUTTING WHEEL ASSEMBLY

FIELD OF THE INVENTION

The present invention relates to cutting tools and, more particularly, to portable cutting tools having a rotatable blade which is useful for cutting food items, for example.

BACKGROUND OF THE INVENTION

There are numerous cutting tools available for cutting food items—including knives and "pizza cutter" style cutting tools. These are easy and convenient to use when a person wishes to cut food items in their own home, such as when sitting down to a meal in their own kitchen or dining room.

Likewise, when eating at a restaurant, knives are generally available for use, and even the side of a fork can be used to cut food into pieces. However, the "pizza cutter" style cutting tool is typically not available for customer use at restaurants. In addition, in many restaurants oriented toward young kids, it is common that only plastic utensils are available, which are not generally suitable for cutting food.

For certain types of food, such as for food that is being prepared for eating by a baby or toddler, use of a pizza cutter style cutting tool is advantageous because of the ability to quickly and efficiently slice food with one-handed use. Often the other hand of a parent is busy ensuring the safety of a baby or toddler or may be holding a number of other items such as a bottle or bib.

A knife generally requires two handed operation with the first hand holding the knife and the second hand holding the item being cut either directly or with another utensil, such as a fork. A fork is not always efficient, especially when a sharp cutting edge is required or when the item being cut has a relatively long dimension requiring cutting, such as a quesadilla, a pancake, a pizza, a sandwich or the like. For these situations, the one-handed operation of a pizza-cutter style cutting implement would be most useful.

In addition to the general lack of availability of pizza-cutter style implements for customer use at restaurants, the typical pizza-cutter style implement is not convenient for carrying around for use in a restaurant—such as carrying in a purse or a diaper bag, for instance. The typical pizza-cutter style implement is not designed in a compact form. Further, the typical pizza-cutter style implement is not conducive to being stored cleanly due to remnants from the food being cut remaining on the cutting wheel after use.

Numerous designs for pizza-cutter style and rotating cutting blade implements exist. These designs are exemplified by the following patents and applications:

U.S. Pat. No. 209,065, Chopping-Knife, issued to Millspaugh on Oct. 15, 1878.

U.S. Design Pat. No. Des. 355,815, Pizza Cutter, issued to La Gro on Feb. 28, 1995.

U.S. Pat. No. 5,428,898, Pizza Cutter, issued to Hawkins on Jul. 4, 1995.

U.S. Pat. No. 5,504,998, Manual Cutting Wheel, issued to Nguyen on Apr. 9,1996;

U.S. Design Pat. No. Des. 375,662, Pizza Cutter, issued to Noga on Nov. 19, 1996.

U.S. Design Pat. No. Des. 397,001, Pizza Cutter, issued to Antista et. al., on Aug. 18, 1998.

U.S. patent application Ser. No. 10/443,615, Rotary-Type Cutting Implement, inventor Cornfield et. al., application date May 23, 2003.

U.S. patent application Ser. No. 10/635,457, Pizza Cutter, inventor Lin, application date Aug. 7, 2003.

U.S. Design Pat. No. Des. 494,823, Cutting Wheel, issued to Overthun et. al., on Aug. 24, 2004.

U.S. Pat. No. 7,134,209, Disc Cutter, issued to Molenaar on Nov. 14, 2006.

U.S. Pat. No. 209,065 discloses a basic pizza-cutter style implement having a handle and a cutting blade, but does not include a center mounting section as disclosed by the present invention nor the conformal blade cover. Similar drawbacks are likewise inherent in design patent D355,815, U.S. Pat. No. 5,428,898, U.S. Pat. No. 5,504,998, design patent D375,662, design patent D397,001, patent application Ser. No. 10/443,615, design patent D494,823, and U.S. Pat. No. 7,134,209.

While patent application Ser. No. 10/635,457 discloses a means of covering the rotating cutting blade, the means of covering the blade is simply a safety feature serving the combined purpose of grasping handle and blade cover, but does not provide the same utility as the present invention where the blade cover fully encloses the cutting blade and is otherwise removable. The full enclosure of the cutting blade is a key improvement over the prior art by providing the ability to cleanly store the device without the worry of having food remnants fall loose from the device, such as to soil other items in a purse or diaper bag for instance.

As such, it may be appreciated that there is a continuing need for a new and improved cutting wheel assembly. In these respects, the present invention provides a method that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

The present invention is a pocket-sized cutting wheel. It is designed to be an easy cutting tool for parents to use in eating establishments to cut their children's food. The present invention includes a low profile integrated handle and conformal blade cover that fits over the rotatable cutting blade and secures to the handle for clean storage.

Briefly, the present invention is directed to a pocket-size cutting wheel having an integral handle constructed optionally of magnetic material. The wheel can slide into a corresponding U-shaped cover. The cover may include a magnetized ridge that functions as a retention means and as a stop means for precluding the further advancement of the circular blade into the cover.

SUMMARY OF THE INVENTION

An objective of the present invention is to provide a portable compact cutting wheel assembly that is easy and convenient to use and can be stored safely and cleanly. The cutting tool allows an individual to cut food items in an efficient and economical manner. As will be described in more detail below, the handle is designed to accommodate the fit of a cover that can be attached over the rotatable cutting blade.

The cutting wheel assembly in accordance with the present invention has a handle, a center mounting member, a preferably round rotatably mounted cutting blade with a peripheral cutting edge and a cutting blade cover. The rotatable cutting blade and particularly the peripheral cutting edge may be formed from a carbide steel or other significantly hardened material which ensures a long and useful working life. When the cutting wheel assembly is not being used, the cutting blade is completely covered by the cover for both safety and cleanliness.

According to a first embodiment of the present invention a cutting wheel assembly is provided comprising a handle, an upper horizontal member, a round cutting blade, a support means for rotatably mounting the round cutting blade to the handle, and a cover.

The handle according to this first embodiment of the invention may further comprise a center mounting member having a first end, a second end, a top side, a bottom side, and a perimeter, first and second vertical members, each having a lower end and an upper end, where the lower end of the first vertical member is attached to and extends upward from the top side of the center mounting member proximal to the first end thereof, and the lower end of the second vertical member is attached to and extends upward from the top side of the center mounting member proximal to the second end thereof.

The upper horizontal member according to this first embodiment of the invention includes a first end and a second end, where the upper end of the first vertical member is attached to and extends downward from the first end of the upper horizontal member and the upper end of the second vertical member is attached to and extends downward from the second end of the upper horizontal member.

The round cutting blade according to this first embodiment of the invention includes a peripheral cutting edge and a rotation axis. The cover includes an upper open end and a lower closed end, first and second broad sides, first and second narrow sides, a U-shaped bottom edge, a hollow inner cavity, and a ridge seat, where the ridge seat is located near the top of the hollow inner cavity, where the upper open end of the cover is conformal to the perimeter of the center mounting member, where the cutting blade and cutting blade mounting struts may be removably positioned within the hollow inner cavity of the cover and the upper open end of the cover may be removably attached to the center mounting member such that the bottom of the center mounting member is in contact with the ridge seat.

The support means according to this first embodiment of the invention comprises a pair of cutting blade mounting struts secured to the bottom of the center mounting member, with said mounting struts extending below the center mounting member to a mounting axis where the cutting blade is rotatably attached between the mounting struts with a cutting blade attachment pin.

According to a second embodiment of the present invention a cutting wheel assembly is provided comprising a center mounting member, a first vertical member, a second vertical member, an upper horizontal member, first and second cutting blade mounting struts, a cutting blade, a cutting blade attachment pin, and a cover.

According to this second embodiment of the invention, the center mounting member includes a first end, a second end, a top side, a bottom side, a perimeter, a center point midway between the first end and second end, and a centerline extending along the middle of the center mounting member between the first end and the second end and dividing the center mounting member into a front half and back half.

According to this second embodiment of the invention, the first vertical member includes an upper end and a lower end, wherein the lower end of the first vertical member is attached to and extends from the top side of the center mounting member proximal to the first end thereof.

According to this second embodiment of the invention, the second vertical member includes an upper end and a lower end, wherein the lower end of the second vertical member is attached to and extends from the top side of the center mounting member proximal to the second end thereof.

According to this second embodiment of the invention, the upper horizontal member includes a top side, a bottom side, a first end, and a second end, where the upper end of the first vertical member is attached to the bottom side of the first end of the upper horizontal member and the upper end of the second vertical member is attached to the bottom side of the second end of the upper horizontal member.

According to this second embodiment of the invention, the first and second cutting blade mounting struts each are provided with an upper end and a lower end, where the lower end of each cutting blade mounting strut has an attachment aperture, where the upper end of the first cutting blade mounting strut is attached to the back half of the center point of the center mounting member and the upper end of the second cutting blade mounting strut is attached to the front half of the center point of the center mounting member.

According to this second embodiment of the invention, the blade includes a peripheral cutting edge and a rotation axis about a center aperture, where the cutting blade center aperture is aligned between the first cutting blade mounting strut attachment aperture and the second cutting blade mounting strut attachment aperture.

According to this second embodiment of the invention, the cutting blade attachment pin passes through the first and second cutting blade mounting strut attachment apertures and the cutting blade center aperture.

According to this second embodiment of the invention, the cover includes an upper open end and a lower closed end, first and second broad sides, first and second narrow sides, a U-shaped bottom edge, a hollow inner cavity, and a ridge seat, where the ridge seat is located near the top of the hollow inner cavity, where the upper open end of the cover is conformal to the perimeter of the center mounting member, where the cutting blade and cutting blade mounting struts may be removably positioned within the hollow inner cavity of the cover and the upper open end of the cover may be removably attached to the center mounting member such that the bottom of the center mounting member is in contact with the ridge seat.

According to a third embodiment of the present invention a cutting wheel assembly is provided comprising a handle, a round cutting blade, said round cutting blade including a peripheral cutting edge and a rotation axis, a support means for rotatably mounting the round cutting blade to the handle, and a cover. The cover according to this third embodiment of the invention is generally U-shaped with an upper open end with an inside top surface, the upper open end exposing a hollow inner cavity, where the cutting blade is removably inserted within the hollow inner cavity of the cover and the upper open end of the cover is removably attached to the handle.

The center mounting member may be made of a magnetic material, and the cover may include a magnetic strip above the ridge seat at the inside top of the hollow inner cavity, said magnetic strip making magnetic attachment to the center mounting member.

Alternatively, the wheel and handle are constructed of magnetic, dishwasher-safe stainless steel. The cover is constructed of transparent dishwasher-safe plastic. A magnetic strip integral to the top inner side of the cover provides a means of detachably securing the cover to the handle.

One form of the cover might include a slight ridge near the top inner side of the cover against which the center mounting member of the handle is seated. This will serve as a stopper when placing the cover over the cutting blade.

A benefit of the present invention conformal cover that, after using the device to cut food, can be easily placed over the cutting wheel so that the entire assembly can be neatly and easily stored back in a diaper bag or purse, for example, without the need to first clean the cutting blade. The cutting wheel and cover can later be cleaned, such as by placing in a dishwasher for easy cleaning.

An added benefit of this device is the fact that it can clip onto a key ring attachment in a diaper bag, for example. A key ring attachment can be clipped onto one of the vertical handle members, for example, so that the device can be stored at an easily accessible location.

For a better understanding of the invention, its operating advantages and the specific objects attained by its uses, reference should be made to the accompanying drawings and descriptive matter in which there are illustrated embodiments of the device used in the method of this invention. Additional features of the invention will be described hereinafter.

It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, it is to be understood that the invention is not limited in its application to the details of construction and to the arrangements of the components set forth in the following description or illustrated in the drawings. The method of the invention is capable of being practiced using other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The foregoing and other objects, features and advantages of the invention will become more fully understood from the following description of the preferred embodiments of the invention as illustrated in the accompanying drawings in which like reference characters refer to the same parts throughout different views. The drawings are not necessarily to scale, emphasis instead being placed upon illustrating the principles of the invention.

DRAWING REFERENCE NUMERALS

Figure 1:
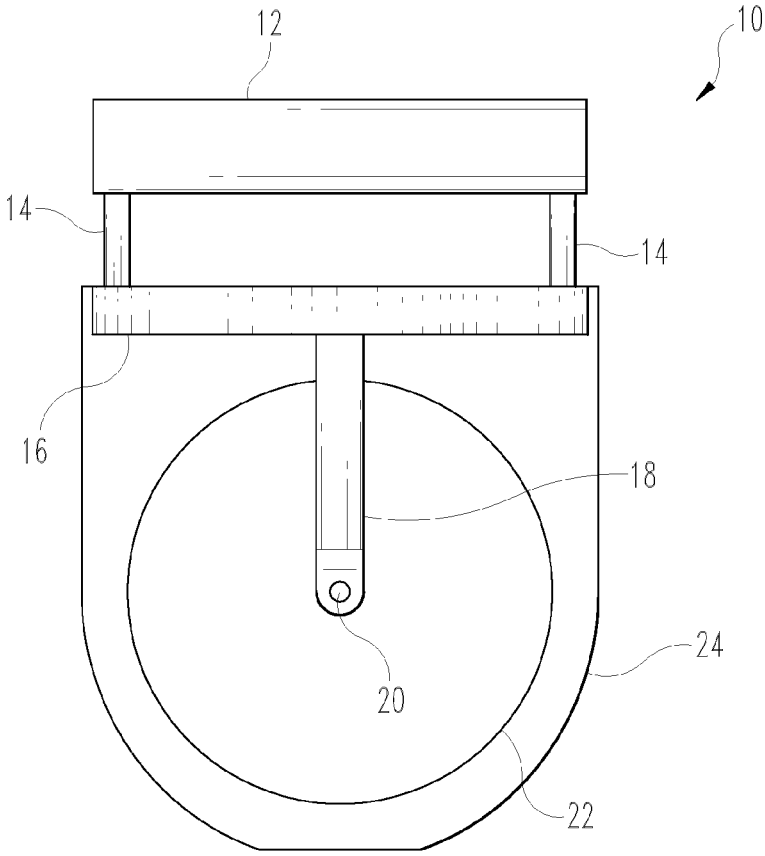
FIG. 1 is a broad side view of the invention, including cutting wheel assembly and cover.

The following table lists the drawing reference numerals with a brief description of each identifying numeral.

| | |
|---|---|
| 10 | Cutting wheel assembly including cover |
| 11 | Cutting wheel assembly without cover |
| 12 | Upper horizontal handle member |
| 14 | Vertical handle members |
| 16 | Center mounting member |
| 18 | Cutting blade mounting struts |
| 20 | Cutting blade attachment pin |
| 22 | Cutting blade |
| 24 | Cover |
| 26 | Ridge seat |
| 28 | Broad side of cover |
| 30 | Bottom edge of cover |
| 32 | Narrow side of cover |
| 34 | Top edge of cover |
| 36 | Top inner side of cover, above ridge seat |

DETAILED DESCRIPTION

With reference now to the drawings, a new cutting wheel assembly 10 in accordance with the present invention will be described. More specifically, referring to FIG. 1, it will be noted that the cutting wheel assembly 10 comprises a handle that includes an upper horizontal handle member 12 and two vertical handle members 14, a center mounting member 16, a pair of cutting blade mounting struts 18, a rotating cutting blade 22 and a cover 24.

Figure 2:
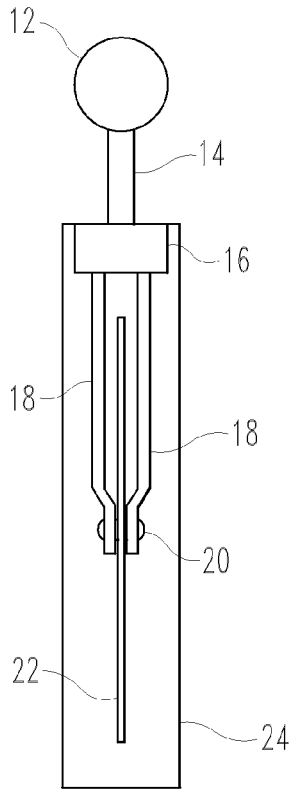
FIG. 2 is a narrow side view of the invention, showing both the cutting wheel assembly and cover.
Figure 3:
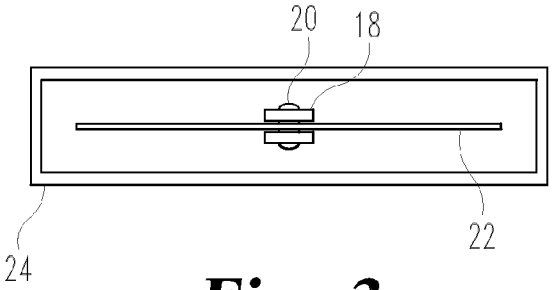
FIG. 3 is a view of the invention from the bottom, showing both the cutting wheel assembly and cover.
Figure 4:
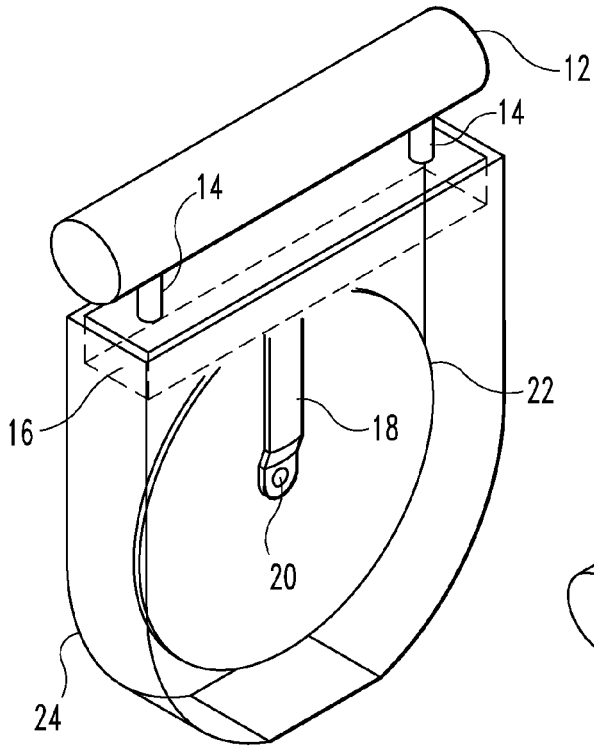
FIG. 4 is a perspective view of the invention, showing both the cutting wheel assembly and cover.
Figure 5:
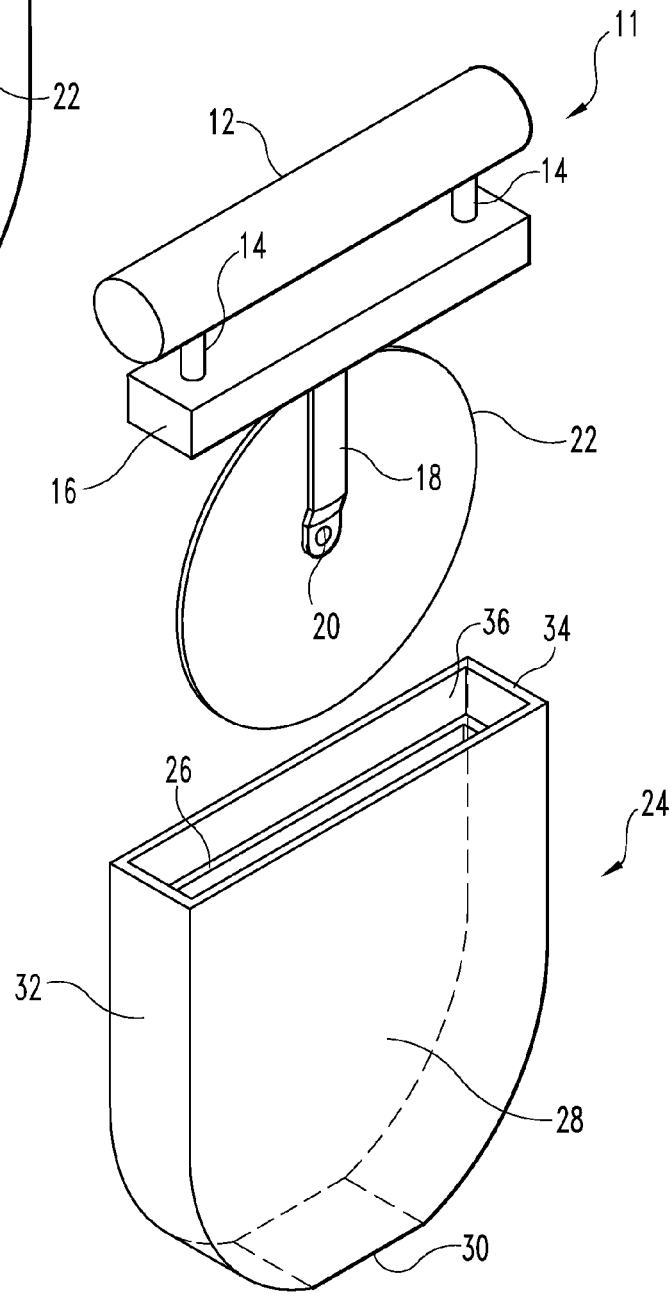
FIG. 5 is an exploded perspective view of the invention, with the cutting wheel and cover shown separately in the exploded view.
Figure 6:
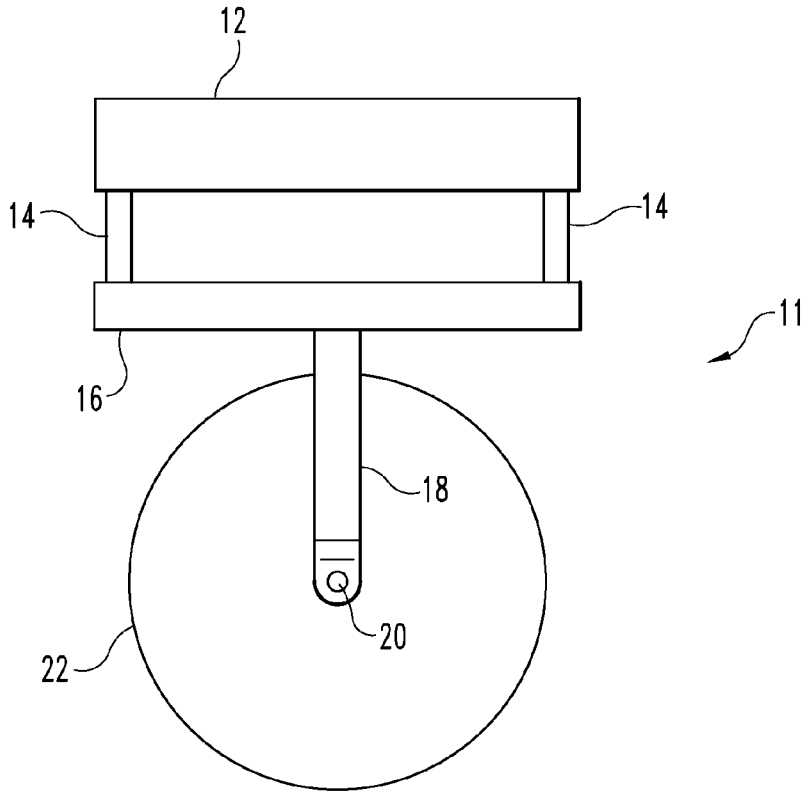
FIG. 6 is a broad side view of the cutting wheel assembly without the cover.

As shown in FIG. 1 and FIG. 2, the vertical handle members 14 are attached at opposite ends of the upper horizontal handle member 12 to form a handle for grasping. The vertical handle members 14 extend below the upper horizontal handle member 12.

The center mounting member 16 provides a mounting platform to which the vertical handle members 14 attach above and the cutting blade mounting struts 18 attach below. Shown most clearly in FIG. 1, the vertical handle members 14 attach at each end of the top of the center mounting member 16.

The center mounting member 16 is defined to have first and second ends, a top side, a bottom side, and a perimeter that consists of the vertical sides. The center mounting member 16 is further defined to have a short centerline that divides the center mounting member 16 in half midway between the first end and second end and also has a long centerline that is orthogonal to the short centerline and divides the center mounting member 16 into a front half and a back half.

The cutting blade mounting struts 18 are attached to the bottom of the center mounting member 16 such that one cutting blade mounting strut 18 is attached to the back half of the bottom of the center mounting member 16 and a second cutting blade mounting strut 18 is attached to the front half of the bottom of the center mounting member 16. The cutting blade mounting struts 18 are separated by a gap that allows the cutting blade 22 to be rotatably mounted between the cutting blade mounting struts 18 such that it rotates freely.

The cutting blade 22 is rotatably attached to the bottom of the cutting blade mounting struts 18. The cutting blade 22 which preferably is circular in shape includes a substantially planar body having an aperture disposed along the axial center point and a peripheral cutting edge which is sharpened along at least one side of the body to allow for cutting as the tool is advanced over the object to be cut. The cutting blade 22 or at least the cutting edge thereof may be formed from a hardened material such as carbide steel, for example, to improve the useful life of the blade.

In one embodiment, a cutting blade attachment pin 20 passes through axially aligned holes in the bottom ends of the cutting blade mounting struts 18 and through the aperture in the center of the cutting blade 22.

The cutting wheel assembly separate from the cover 11 may be formed from a variety of different materials such as aluminum, stainless steel or plastic, for example.

As shown in the figures, the cutting wheel assembly 10 includes a cover 24 that houses the cutting blade 22 and cutting blade mounting struts 18. The cover 24 attaches to the bottom of the center mounting member 16 to provide a means of covering the cutting blade 22 both for safety and for cleanliness. After the cutting blade 22 is used to cut food, for instance, the cover 24 can be attached to ensure the loose food particles do not soil the storage location of the cutting wheel assembly 10.

Figure 7:
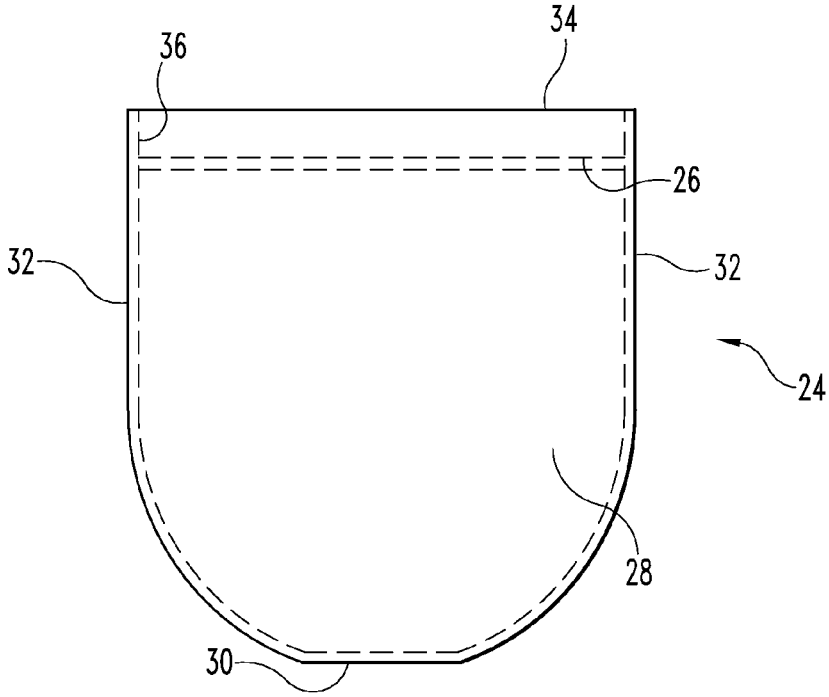
FIG. 7 is a broad side view of the cover.
Figure 8:
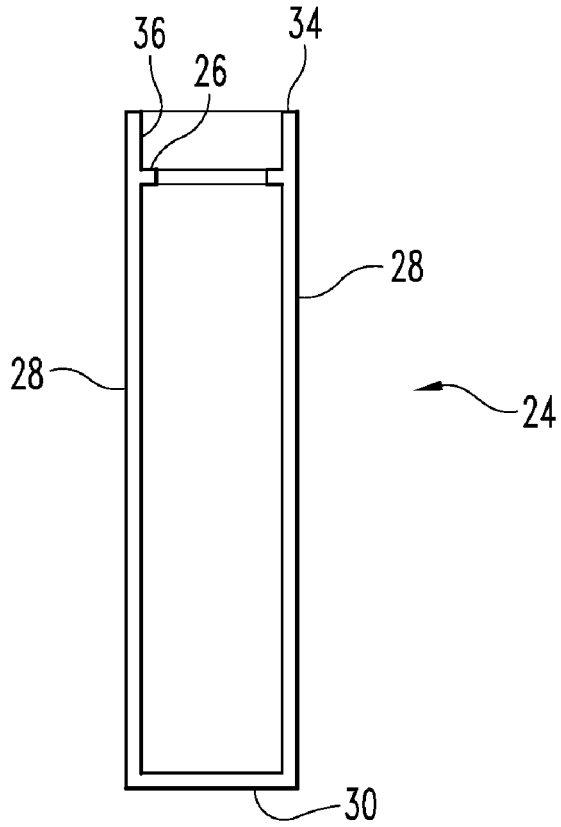
FIG. 8 is a narrow side view of the cover.
Figure 9:
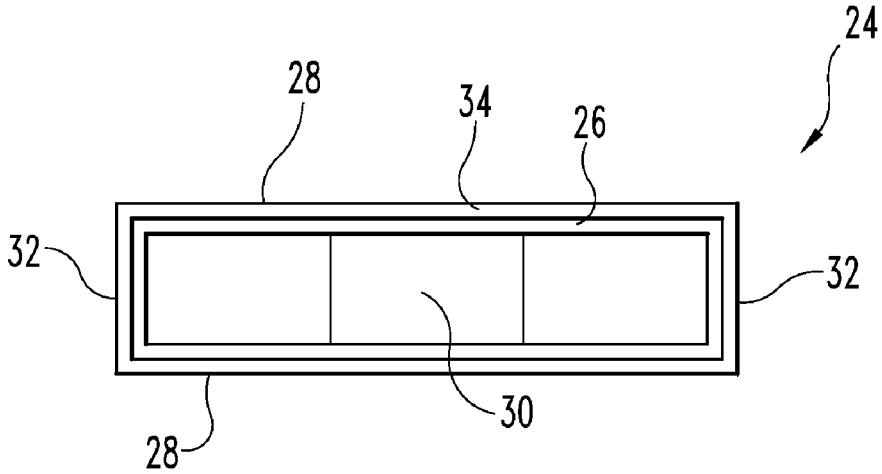
FIG. 9 is a view of the cover from the bottom.

As shown in FIG. 7, one embodiment of the cover 24 is comprised of a top edge 34, a bottom edge 30, two broad sides 28, two narrow sides 32, a ridge seat 26 and a top inner side 36 above the ridge seat 26. The cover 24 may be formed from a metal or plastic material, which can optionally be transparent, and has a hollow inner cavity that accommodates the insertion of the cutting blade 22.

In the embodiment shown in the figures, the cover top inner side 36 is formed in a shape to fit conformally around the perimeter of the center mounting member 16. The ridge seat 26 comprises a ridge around the inside cavity of the cover 24 so that the bottom of the center mounting member 16 rests against and is stopped by the ridge seat 26 when the cover 24 is attached to the center mounting member 16 over the cutting blade 22 and cutting blade attachment struts 18.

While it will be apparent that the preferred embodiments of the invention disclosed are well calculated to fulfill the objects stated, it will be appreciated that the invention is susceptible to modification, variation and change without departing from the spirit thereof. For instance, while the center mounting member 16 is illustrated in the figures as a rectangular shape, it is understood that the shape could be another suitable shape, such as with rounded edges.

From the foregoing, it will be understood by persons skilled in the art that an improved cutting wheel assembly has been provided. The invention is relatively simple and easy to manufacture, yet affords a variety of uses. While the foregoing description contains much specificity, these should not be construed as limitations on the scope of the version of the invention, but rather as an exemplification of the preferred embodiments thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A cutting wheel assembly, comprising:

a handle, said handle further comprising, a center mounting member having a first end, a second end, a top side, a bottom side, and a perimeter, first and second vertical members, each having a lower end and an upper end, where the lower end of the first vertical member is attached to and extends upward from the top side of the center mounting member proximal to the first end thereof, and the lower end of the second vertical member is attached to and extends upward from the top side of the center mounting member proximal to the second end thereof, an upper horizontal member having a first end and a second end, where the upper end of the first vertical member is attached to and extends downward from the first end of the upper horizontal member and the upper end of the second vertical member is attached to and extends downward from the second end of the upper horizontal member;

a round cutting blade, said round cutting blade including a peripheral cutting edge and a rotation axis;

a support means for rotatably mounting the round cutting blade to the handle; and a cover having an upper open end and a lower closed end, first and second broad sides, first and second narrow sides, a U-shaped bottom edge, a hollow inner cavity, and a ridge seat, where the ridge seat is located near the top of the hollow inner cavity, where the upper open end of the cover is conformal to the perimeter of the center mounting member, where the cutting blade and cutting blade mounting struts can be removably positioned within the hollow inner cavity of the cover and the upper open end of the cover may be removably attached to the center mounting member such that the bottom of the center mounting member is in contact with the ridge seat.

2. The cutting wheel assembly according to claim 1, wherein said support means comprises a pair of cutting blade mounting struts secured to the bottom of the center mounting member, with said mounting struts extending below the center mounting member to a mounting axis where the cutting blade is rotatably attached between the mounting struts with a cutting blade attachment pin.

3. The cutting wheel assembly of claim 1, where the center mounting member is made of a magnetic material.

4. A cutting wheel assembly, comprising:

a center mounting member having a first end, a second end, a top side, a bottom side, a perimeter, a center point midway between the first end and the second end, and a centerline extending along the middle of the center mounting member between the first end and the second end and dividing the center mounting member into a front half and a back half, a first vertical member having an upper end and a lower end, wherein the lower end of the first vertical member is attached to and extends from the top side of the center mounting member proximal to the first end thereof, a second vertical member having an upper end and a lower end, wherein the lower end of the second vertical member is attached to and extends from the top side of the center mounting member proximal to the second end thereof, an upper horizontal member having a top side, a bottom side, a first end, and a second end, where the upper end of the first vertical member is attached to the bottom side of the first end of the upper horizontal member and the upper end of the second vertical member is attached to the bottom side of the second end of the upper horizontal member, first and second cutting blade mounting struts, each with an upper end and a lower end, where the lower end of each cutting blade mounting strut has an attachment aperture, where the upper end of the first cutting blade mounting strut is attached to the back half of the center point of the center mounting member and the upper end of the second cutting blade mounting strut is attached to the front half of the center point of the center mounting member, a cutting blade, said blade including a peripheral cutting edge and a rotation axis about a center aperture, where the cutting blade center aperture is aligned between the first cutting blade mounting strut attachment aperture and the second cutting blade mounting strut attachment aperture, a cutting blade attachment pin that passes through the first and second cutting blade mounting strut attachment apertures and the cutting blade center aperture, a cover having an upper open end and a lower closed end, first and second broad sides, first and second narrow sides, a U-shaped bottom edge, a hollow inner cavity, and a ridge seat, where the ridge seat is located near the top of the hollow inner cavity, where the upper open end of the cover is conformal to the perimeter of the center mounting member, where the cutting blade and the cutting blade mounting struts can be removably positioned within the hollow inner cavity of the cover and the upper open end of the cover can be removably attached to the center mounting member such that the bottom of the center mounting member is in contact with the ridge seat.

5. The cutting wheel assembly of claim 4, where the center mounting member is made of a magnetic material.

* * * * *